US006279848B1

(12) United States Patent
Mead, Jr.

(10) Patent No.: US 6,279,848 B1
(45) Date of Patent: Aug. 28, 2001

(54) REEL HAVING AN IMPROVED RECIPROCATING MECHANISM

(75) Inventor: Russell C. Mead, Jr., Mountain View, CA (US)

(73) Assignee: Great Stuff, Inc., San Leandro, CA (US)

( * ) Notice: Subject to any disclaimer, the term of this patent is extended or adjusted under 35 U.S.C. 154(b) by 0 days.

(21) Appl. No.: 09/714,363

(22) Filed: Nov. 15, 2000

Related U.S. Application Data

(60) Provisional application No. 60/197,132, filed on Apr. 14, 2000.

(51) Int. Cl.[7] ..... B65H 27/00; B65H 57/00

(52) U.S. Cl. ..... 242/397.3

(58) Field of Search ..... 242/397.3, 277, 242/280, 281, 483.5

(56) References Cited

U.S. PATENT DOCUMENTS

| | | |
|---|---|---|
| D. 419,961 | 2/2000 | Weatherill . |
| 2,494,003 | 1/1950 | Russ . |
| 2,540,434 | 2/1951 | Fengler . |
| 2,855,163 | 10/1958 | Powers . |
| 2,933,264 | 4/1960 | Bullen et al. . |
| 3,101,846 | 8/1963 | Eifrid . |
| 3,156,998 | 11/1964 | McDaniel . |
| 3,224,705 | 12/1965 | Nash . |
| 3,469,801 | 9/1969 | Hauck et al. . |
| 3,493,105 | 2/1970 | Greb et al. . |
| 3,670,977 | 6/1972 | Boneck . |
| 3,780,963 | 12/1973 | Hirschfelder . |

(List continued on next page.)

FOREIGN PATENT DOCUMENTS

| | | |
|---|---|---|
| 2443413 | 12/1978 | (FR) . |
| 52-48082 | 4/1977 | (JP) . |
| 3-111376 | 7/1991 | (JP) . |
| 6-100247 | 4/1994 | (JP) . |

OTHER PUBLICATIONS

BusinessWeek, "Concepts–Capital Ideas", pp. 116–117 (Jun. 12, 2000).

*Primary Examiner*—William A. Rivera
(74) *Attorney, Agent, or Firm*—Knobbe, Martens, Olson & Bear, LLP

(57) ABSTRACT

A reel comprises a drum assembly enclosed within a shell comprising upper and lower shell portions. The drum assembly is secured to the lower shell portion. The drum assembly comprises a motor-driven rotating drum rigidly secured between two discs, and a frame subassembly. The drum is adapted to received a linear material spooled thereon. A first of the discs has a spiral groove on an outer surface thereof. The spiral groove has a first end near the center of the first disc and a second end near an outer edge thereof. The second end is tapered to lesser depth. The frame subassembly comprises side plates enclosing the drum and discs. A first side plate has a track assembly attached to its inner surface, and a translating plate adapted to translate horizontally within the track assembly. The translating plate has a horizontal pin at each of its ends, which pins are adapted to be received within the spiral groove of the first disc. As the drum and discs rotate, the horizontal pins alternatingly engage the spiral groove, causing the translating plate to translate linearly within the track assembly. The translating plate is connected to the upper shell portion, causing the upper shell portion to reciprocatingly rotate about a vertical axis with respect to the lower shell portion and drum assembly. A guide aperture is provided in the upper shell portion, through which linear material is drawn onto the rotating drum. Advantageously, the aperture translates through an arc in front of the drum, so that the linear material is distributed across the drum surface as it is wound.

41 Claims, 15 Drawing Sheets

U.S. PATENT DOCUMENTS

| | | | | |
|---|---|---|---|---|
| 3,804,350 | | 4/1974 | Williams . | |
| 3,804,370 | | 4/1974 | Woodard . | |
| 3,833,184 | | 9/1974 | Hara et al. . | |
| 3,848,405 | * | 11/1974 | Karlson | 242/483.5 X |
| 3,876,045 | | 4/1975 | Knarreborg . | |
| 3,889,896 | | 6/1975 | O'Hara . | |
| 4,014,422 | | 3/1977 | Morishita . | |
| 4,223,710 | | 9/1980 | Brothers . | |
| 4,277,011 | | 7/1981 | Jeter . | |
| 4,330,005 | | 5/1982 | Kjarsgaard . | |
| 4,343,443 | | 8/1982 | Grounds . | |
| 4,437,601 | | 3/1984 | Brooks . | |
| 4,458,856 | | 7/1984 | Mansel-James . | |
| 4,513,772 | | 4/1985 | Fisher . | |
| 4,543,982 | | 10/1985 | Wolfe . | |
| 4,591,110 | | 5/1986 | Wirts et al. . | |
| 4,618,039 | | 10/1986 | Omata . | |
| 4,660,698 | | 4/1987 | Miura . | |
| 4,723,727 | | 2/1988 | Weber . | |
| 4,796,831 | | 1/1989 | Sheppard . | |
| 4,832,074 | | 5/1989 | Li . | |
| 4,874,138 | | 10/1989 | Kettenring . | |
| 4,901,832 | | 2/1990 | Werner . | |
| 4,969,610 | | 11/1990 | Taylor et al. . | |
| 5,027,022 | | 6/1991 | Tanaka et al. . | |
| 5,070,978 | | 12/1991 | Pires . | |
| 5,183,218 | | 2/1993 | Gavagna . | |
| 5,273,234 | | 12/1993 | Hitomi . | |
| 5,375,786 | | 12/1994 | Ta-Yueh et al. . | |
| 5,385,314 | | 1/1995 | Hughes . | |
| 5,390,695 | | 2/1995 | Howard . | |
| 5,449,057 | | 9/1995 | Frank . | |
| 5,485,905 | | 1/1996 | Rader, III . | |
| 5,557,987 | | 9/1996 | Lötsch . | |
| 5,566,898 | | 10/1996 | Cline . | |
| 5,722,613 | | 3/1998 | Michael . | |
| 5,782,412 | | 7/1998 | Plantz et al. . | |
| 5,918,715 | | 7/1999 | Ruth et al. . | |
| 6,050,290 | * | 4/2000 | Tacobi et al. | 242/397.3 X |

* cited by examiner

REEL HAVING AN IMPROVED RECIPROCATING MECHANISM

REFERENCE TO RELATED APPLICATION

The present application claims the priority benefit under 35 U.S.C. §119(e) of provisional application No. 60/197,132, filed Apr. 14, 2000 of Mead et al.

BACKGROUND OF THE INVENTION

1. Field of the Invention

The present invention relates generally to reels for spooling linear material and, in particular, to a reel including an improved reciprocating mechanism for distributing linear material across a rotating reel drum.

2. Description of the Related Art

Reels for spooling linear material, such as a hose or wire, onto a rotating drum have incorporated reciprocating motion of a guide through which the linear material passes, to advantageously cause the linear material to be wrapped substantially uniformly around most of the surface area of the drum.

Several methods have been utilized in the past for achieving such reciprocating motion. One common approach is to use a rotating reversing screw which causes a guide to translate back and forth in front of a rotating drum. For example, such an approach is shown in U.S. Pat. No. 2,494,003 to Russ. However, such reversing screws tend to wear out quickly, degrading reel performance and necessitating frequent replacement.

Another approach for producing reciprocating motion of the guide is to use a motor to control a rotating screw upon which the guide translates. In this class of reels, the motor reverses the direction of rotation of the screw whenever the guide reaches an end of the screw. Unfortunately, the repeated reversing of the motor increases the spooling time and causes the motor to wear down sooner. Other reels have incorporated significantly more complicated gear mechanisms for achieving the reciprocating motion.

Many reel constructions include exposed moving parts, such as the reel drum, guide, and motor. Over time, such moving parts can become damaged due to exposure. For example, an outdoor reel is exposed to sunlight and rain. Such exposure can cause the moving parts of the reel to wear more rapidly, resulting in reduced performance quality.

Thus, there is a need for an improved reel having a simple reciprocating mechanism which produces reciprocating motion of a guide.

SUMMARY

Accordingly, it is a principle object and advantage of the present invention to overcome some or all of these limitations and to provide an improved reel incorporating reciprocating motion of a guide.

In accordance with one aspect, the present invention provides a reciprocating mechanism, comprising a plate and a translating member. The plate is adapted to rotate about an axis, and has a spiral groove spiraling about the axis. The translating member has first and second groove engagement portions which are configured to selectively engage the groove of the plate. The translating member is configured so that, during rotation of the plate about the axis, the groove engagement portions alternately engage the groove on opposite sides of the axis. This causes the translating member to translate linearly as the plate rotates in one rotary direction about the axis.

In accordance with another aspect, the present invention provides a reel comprising a drum and a shell substantially surrounding the drum. The drum is configured to rotate about a drum axis and to receive a spool of linear material being wrapped around a spool surface of the drum as the drum rotates. A reciprocating mechanism is configured to reciprocatingly rotate at least a portion of the shell. The portion includes an aperture which reciprocates through an arc across the spool surface as the shell portion reciprocatingly rotates about the shell axis.

In the illustrated embodiments, the aperture guides linear material onto the spool surface as the shell reciprocatingly rotates about the shell axis and as the drum rotates about the drum axis. The linear material is thus splayed across the drum as the drum winds the linear material, maximizing packing and avoiding tangles. Similar reciprocation helps to more smoothly extract linear material during unwinding. The reciprocating mechanism of the illustrated embodiments is a spiral groove and translating member, as described with respect to the first aspect of the invention.

In accordance with another aspect, the present invention provides a method of spooling linear material. The method includes providing a drum and a shell around the drum, where a portion of the shell has an aperture through it. The drum rotates about a first axis. The shell portion with the aperture rotates about a second axis as the drum rotates about the first axis. As the drum rotates, linear material is drawn through the aperture and wound about the drum and is distributed across the spool surface by the reciprocating rotation of the shell portion.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these aspects are intended to be within the scope of the invention herein disclosed. These and other aspects of the present invention will become readily apparent to those skilled in the art from the appended claims and from the following detailed description of the preferred embodiments having reference to the attached figures, the invention not being limited to any particular preferred embodiment(s) disclosed.

DETAILED DESCRIPTION

Figure 1:
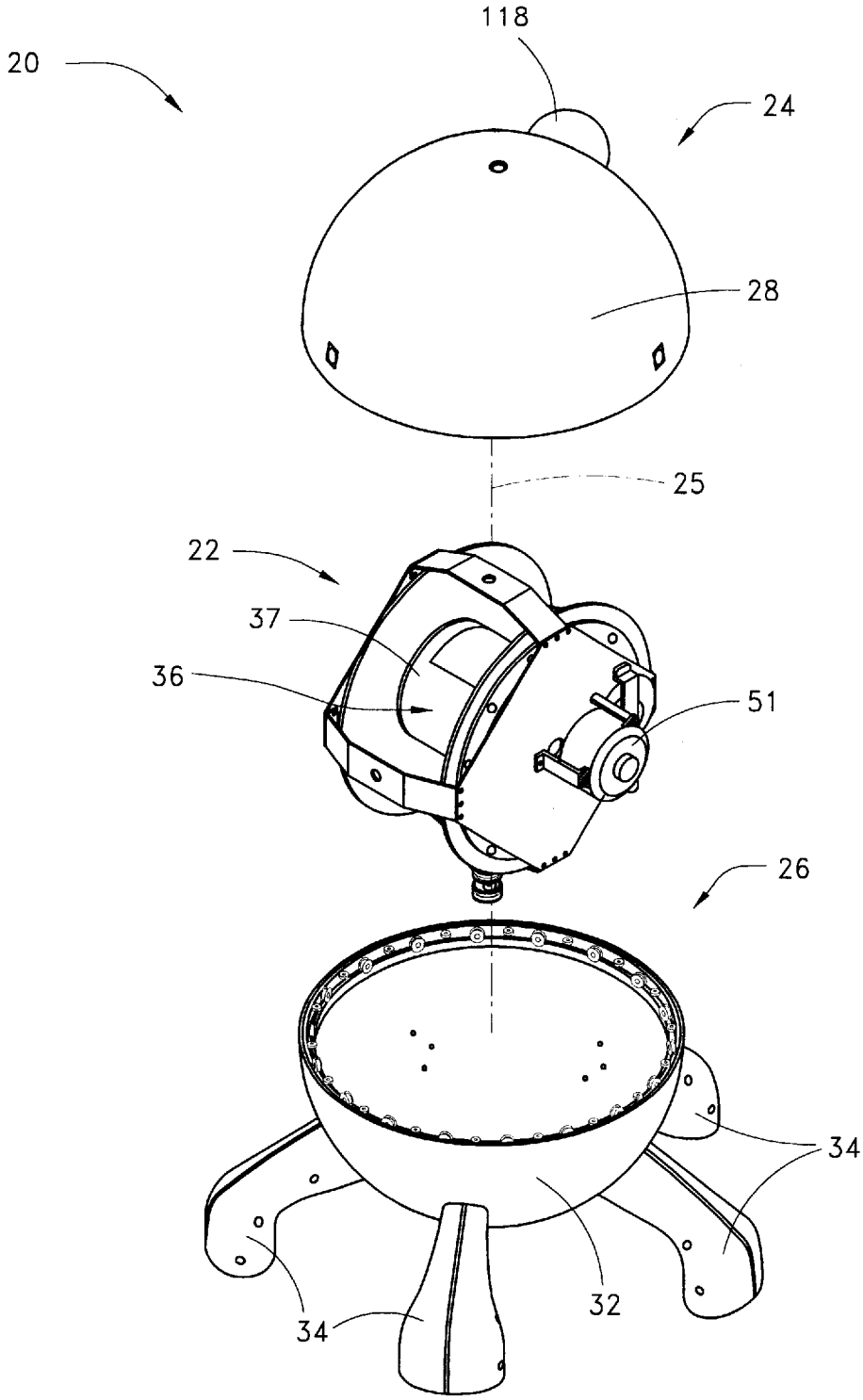
FIG. 1 is a front perspective view of a disassembled reel, including a housing, according to one embodiment of the present invention.

FIG. 1 shows, in disassembled form, one embodiment of a reel 20 including an improved reciprocating mechanism for substantially uniformly spooling linear material, such as a hose, cable, or wire, across a rotating reel drum 36. The reel 20 comprises a drum assembly 22 enclosed within a shell comprising an upper shell portion 24 and a lower shell portion 26. In the illustrated embodiment, the shell portions 24 and 26 comprise semi-spherical upper and lower domes 28 and 32, respectively. However, the shell portions may have other shapes (e.g., rectangular) without affecting the functionality of the winding mechanism described herein. The lower shell portion 26 includes a plurality of legs 34 for supporting the reel 20 on a support surface. In other arrangements, the reel can be supported upon wheels. A guide member 118, defining an aperture to accept linear material such as garden hose, is adapted to be affixed to the upper dome 28. The guide member 118 is described in further detail below with respect to FIG. 5.

Figure 2:
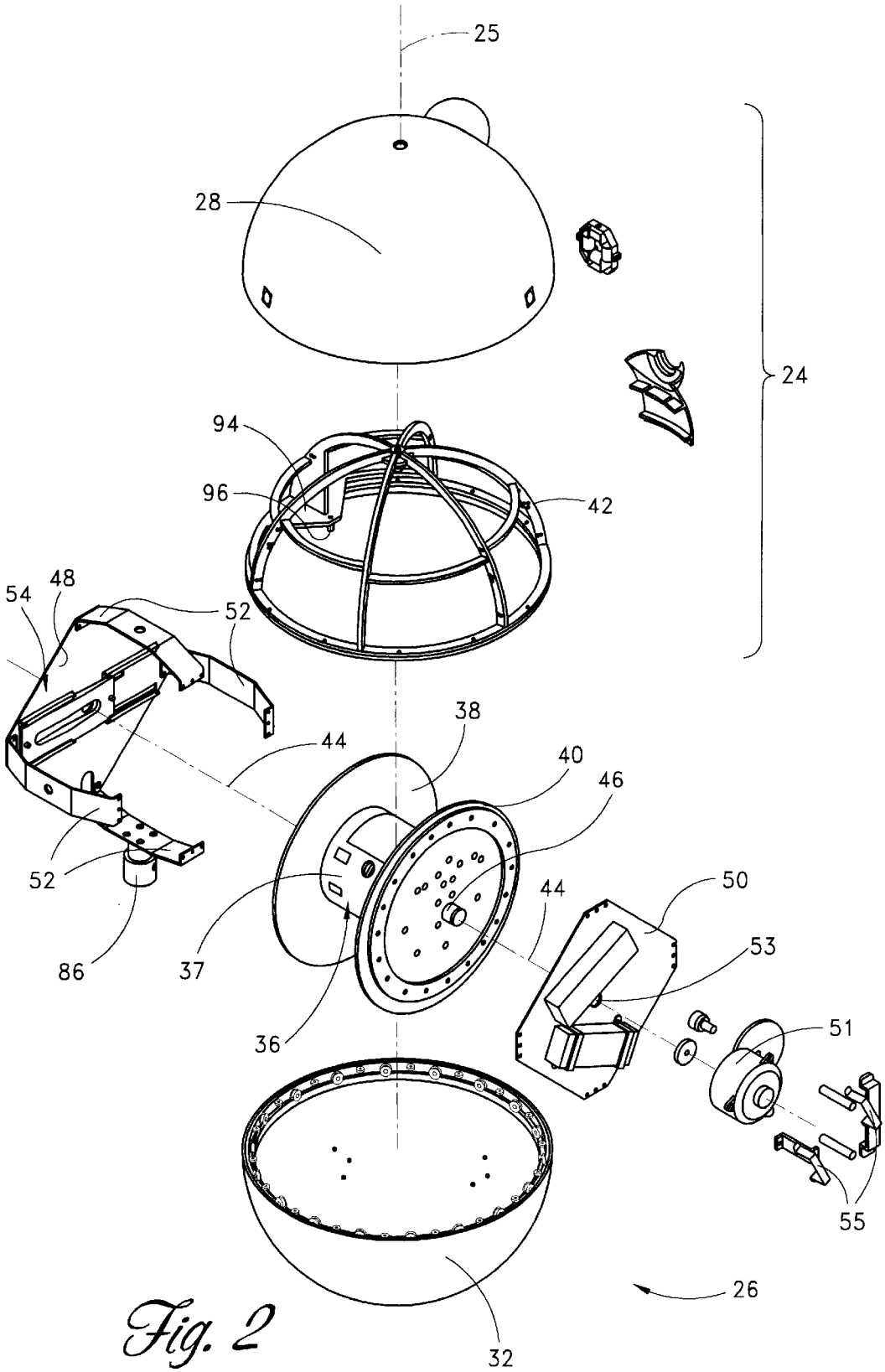
FIG. 2 is a front perspective view of the reel of FIG. 1, with the drum assembly shown disassembled.

FIG. 2 illustrates in greater detail a preferred configuration of the reel 20. The upper shell portion 24 comprises the dome 28 and an upper shell frame 42. The upper dome 28 is adapted to fit securely onto the frame 42, so that the dome 28 and the frame 42 do not move relative to one another. The bottom edge of the frame 42 is adapted to engage the upper edge of the lower dome 32 of the lower shell portion 26. Preferably, the upper shell portion 24 can rotate with respect to the lower shell portion 26, about a central first or shell axis 25, illustrated as a vertical axis in the figures. The preferred interface between the upper and lower shell portions 24 and 26 is described in greater detail below. Alternatively, the entire shell 24, 26 can rotate together relative to the drum assembly 22.

The drum assembly 22 includes a preferably cylindrical drum 36 having a spool surface 37. The drum 36 is rigidly secured between plates, such as discs 38 and 40 in the illustrated embodiment. The drum 36 and the discs 38, 40 are adapted to rotate together about a second or drum axis of rotation 44, illustrated as horizontal and thus orthogonal to the shell axis 25. Preferably, axial knobs 46 and 47 (FIG. 7) are attached to the outer surfaces of the discs 38 and 40, respectively, and are aligned with the second axis 44.

The drum assembly 22 also includes a frame subassembly 23 (FIG. 3) surrounding the drum 36 and the discs 38, 40. The frame subassembly includes two side plates 48, 50 and a plurality of connection supports 52 providing a structural connection between the side plates 48, 50. The connection supports 52 are attached to the side plates 48, 50 at or near their outer edges, and do not interfere with the rotation of the drum 36 and discs 38, 40. In the illustrated embodiment, the side plates 48, 50 are shaped like squares with chamfered corners, and the four connection supports 52 are attached to the side plates 48, 50 near the corners thereof. The connection supports 52 may be secured to the side plates by any of a variety of means, such as rivets, nut and bolt combinations, welding, bonding, etc., giving due consideration to the goals of rigidity and a long-lasting connection. An alternative and much simplified frame subassembly is shown in FIGS. 10–15.

As shown in FIG. 2, a motor 51 can be secured onto the outer surface of the side plate 50. The side plate 50 preferably has a hole 53 aligned with the drum axis 44, the hole 53 being adapted to receive the axial knob 46. Preferably, the motor 51 is configured to engage the knob 46 to rotate the drum 36 and the discs 38, 40. The motor 51 may be secured to the frame subassembly 23 by any of a variety of means, such as clamps 55 (shown), nut and bolt combinations, etc., keeping in mind the goals of rigidity, durability, and maintaining a precise alignment between the axis of rotation of the motor 51 and the drum axis 44. The motor 51 can be wired to an on/off switch exterior to, or on an exterior surface of, the reel 20. Alternatively, the motor 51 can be operable by a remote control.

Advantageously, the shell substantially surrounds and preferably encloses the drum assembly 22 to protect it from exposure to sunlight, rain, etc. This results in less wear and tear and a longer life of the components of the drum assembly 22, the motor 51, and the other components of the reel 20.

Figure 3:
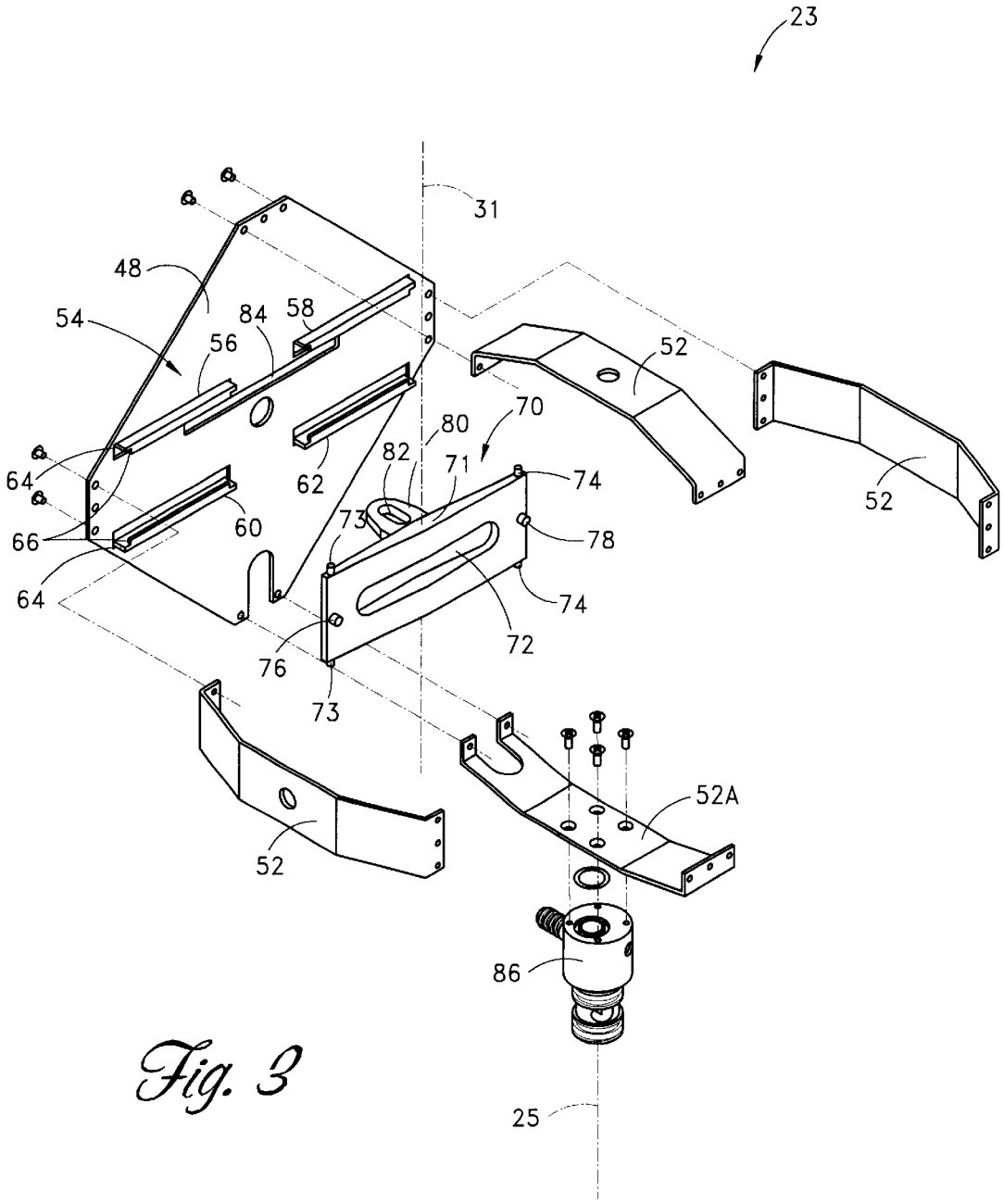
FIG. 3 is an exploded front perspective view of a portion of the frame subassembly of the reel of FIG. 1, shown disassembled.

FIG. 3 shows in greater detail the configuration of the frame subassembly 23 of the drum assembly 22. The frame subassembly 23 includes an elongated translating member or plate 70 having a horizontal slot 72 therein. The slot 72 is adapted to receive the axial knob 47 (FIG. 7) secured to the outer surface of the disc 38 and aligned with the drum axis 44. Preferably, the translating member 70 has at least first and second track engagement portions configured to translate within tracks of a track assembly 54 attached to the inner surface of the side plate 48, described below. In the illustrated embodiment, the first and second track engagement portions comprise pairs of vertical pins 73 and 74, respectively, attached to the corners of the translating member 70. The pins 73 and 74 are adapted to be received and to translate within the tracks of the track assembly 54. In particular, the first pins 73 are attached at one end of the translating member 70, and the second pins 74 are attached at the other end thereof.

The translating member 70 also has first and second groove engagement portions adapted to engage a spiral groove 88 on the outer surface of plate or disc 38 (FIG. 6), described in more detail below. In one embodiment, the groove engagement portions comprise horizontal pins 76 and 78 attached at or near the ends of the inner surface of the translating member 70. Each of the pins 76 and 78 is adapted to be received within the spiral groove 88. As shown in FIG.

3, the thickness of the translating member 70 is preferably tapered, such that its maximum thickness is at its center portion 71, defining a pivot axis 31. The tapered thickness of the translating member 70 causes the pins 76 and 78 to alternatingly engage, i.e., be received within, the spiral groove 88, as described in further detail below. The skilled artisan will appreciate that translating member 70 can be pivoted about the pivot axis 31 by mechanisms other than the thickened central portion 71. The translating member 70 preferably also has an arm 80 on its outer surface, the arm containing a slot 82 as shown. The arm 80 engages and rotates the upper shell portion 24 during reciprocal translation of the translating member 70, described in greater detail below.

In the illustrated embodiment, the track assembly 54 forms part of the frame subassembly 23 and comprises upper track members 56 and 58 and lower track members 60 and 62. Since these track members are preferably identical in configuration, only one of the track members, particularly the lower track member 60, is described. The track member 60 comprises an elongated horizontal track portion 64 secured at an outer longitudinal edge to the inner surface of the side plate 48, and an elongated vertical track portion 66 attached at one longitudinal edge to the inner longitudinal edge of the horizontal track portion 64. The track members 56, 58, 60, and 62 together form a track within which a portion of the translating member 70 is adapted to translate. In the illustrated embodiment, the pins 73 and 74 of the translating member 70 are adapted to alternately translate within the track defined by the track assembly 54. The side plate 48 also includes a horizontal slot 84 sized to receive the arm 80 of the translating member 70 when the member 70 translates along the length of the track defined by the track assembly 54.

In alternative configuration, the track assembly can define an outer track and an inner track. The outer track and the inner track would each be adapted to alternately receive the pins of the translating member 70 (FIG. 3), so that the translating member 70 can translate therein. When the pins 73 are within the outer tracks of the track members, the pins 74 are within the inner tracks of the track members, and vice-versa.

As shown in FIG. 3, a lowermost connection support 52A is configured to be secured to a vertical base connection member 86 which connects the drum assembly 22 to the lower shell portion 26 (FIG. 1). The connection member 86 can be attached to a lower inner surface of the lower shell portion 26. The connection member 86 supports the drum assembly 22 so that the drum assembly does not impede any relative rotation between the shell portions 24 and 26. More preferably, the connection member 86 permits free 360° rotation between the lower support surface and the combination of the drum assembly 22 and the upper shell portion 24. Any of a variety of attachment methods may be used for attaching the connection member 86 to the lowermost connection support 52A and to the lower shell portion 26, such as nut and bolt combinations, welding, bonding, etc., keeping in mind the goals of a rigid and longlasting connection.

Figure 4:
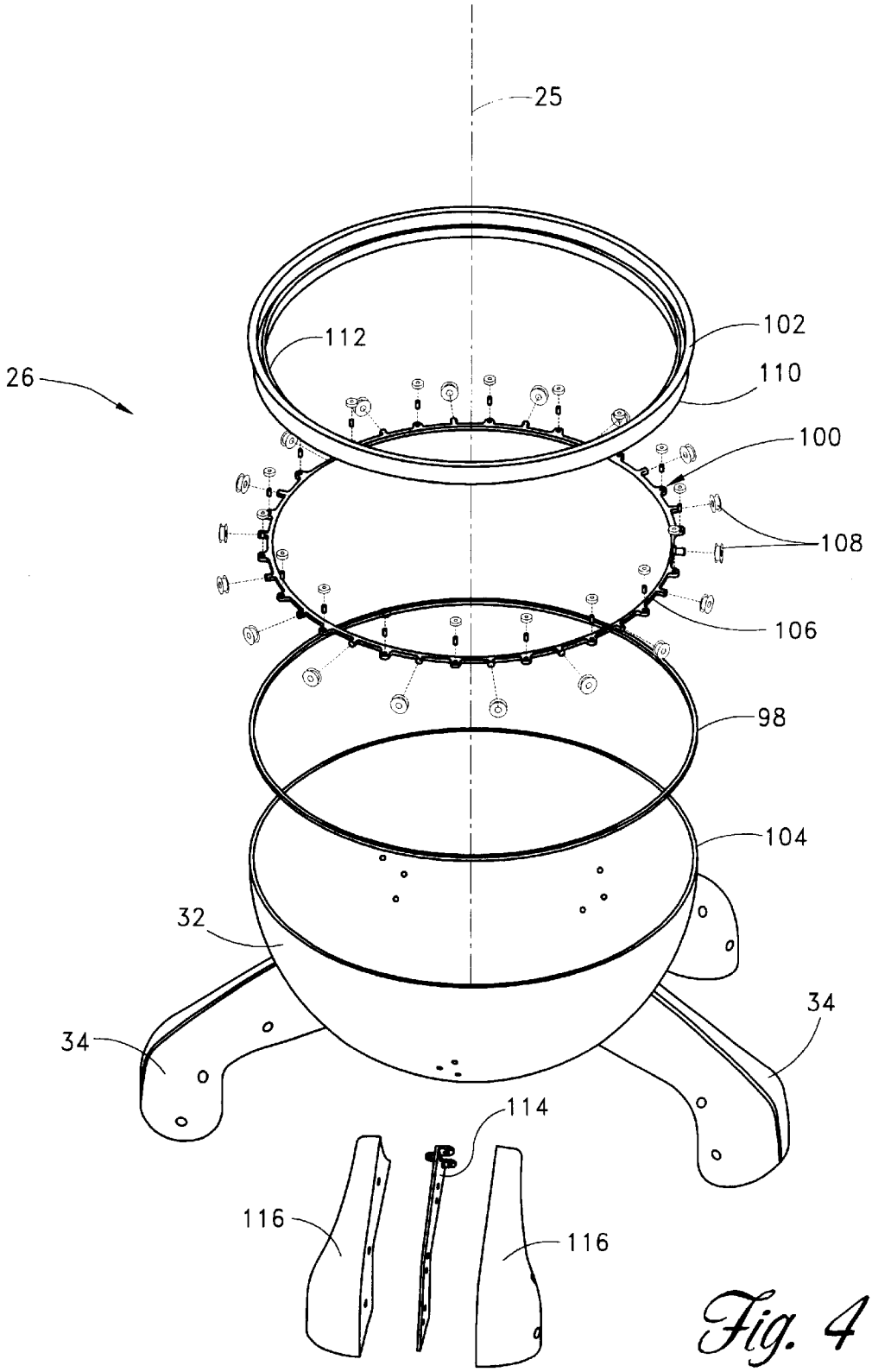
FIG. 4 is a front perspective view of the bottom shell portion of the reel of FIG. 1, shown disassembled.

FIG. 4 shows one embodiment of the lower shell portion 26 in disassembled form. The lower shell portion 26 comprises the hemispherical dome 32, the legs 34, a ring 98, a roller bearing 100, and a bearing race 102. The ring 98 fits onto the upper edge 104 of the dome 32. The roller bearing 100 comprises a ring 106 having a plurality of wheels 108 attached thereto as shown. The wheels 108 have female grooves sized to fit onto and roll with respect to the ring 98. FIG. 4 also shows tabs on the ring 106 for fitting horizontal wheels that reduce friction with upper shell portion. The wheels 108 are also sized to receive and roll with respect to the lower edge 110 of the bearing race 102. The bearing race 102 has an interior ridge 112 configured to receive the lower edge of the upper shell portion 24 (FIG. 1). Thus, the wheels 108 permit the upper shell portion 24 to rotate with respect to the lower shell portion 26. It will be understood that other structures can serve this function. The skilled artisan will readily appreciate a variety of other bearing arrangements can be substituted to facilitate relative rotation of the parts, such as lubrication and/or low-friction high density plastic bearing surfaces.

In the illustrated embodiment, each leg 34 of the lower shell portion 26 comprises an interior leg plate support 114 and left and right cosmetic leg portions 116. The support 114 is configured to be secured to the lower dome 32 by, for example, rivets, nut and bolt combinations, bonding, welding, etc. The cosmetic leg portions 116 are secured onto the sides of the interior leg plate support 114 as shown. Those skilled in the art will understand that the portions 116 may be secured onto the leg plate support 114 by any of a variety of attachment methods, such as those mentioned previously herein. As noted, the lower shell portion 26 can be supported by a variety of manners, including wheeled support.

Figure 5:
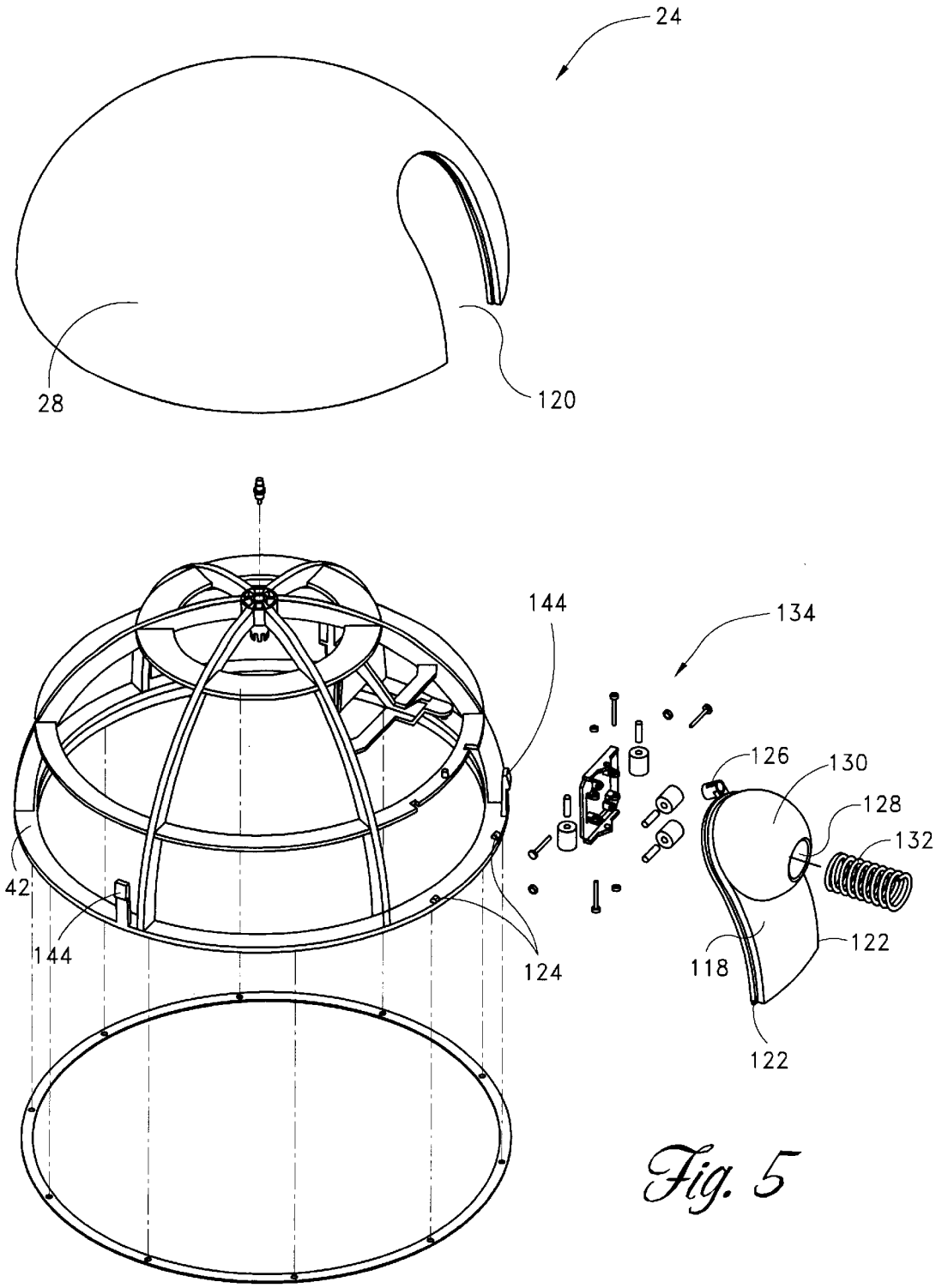
FIG. 5 is an exploded perspective view of the upper shell portion, shown disassembled.

FIG. 5 shows in greater detail the preferred configuration of the upper shell portion 24 (FIG. 1). The upper shell portion 24 comprises the upper hemispherical dome 28, the shell frame 42, a guide member 118, and a roller assembly 134. The guide member 118 is configured to be attached to the shell frame 42. In the illustrated embodiment, the guide member 118 includes pins 122 on its lower side surfaces, the pins 122 being adapted to be received within pin housings 124 on the shell frame 42. The guide member 118 can also have an attachment portion 126 that is adapted to be secured to the shell frame 42. As shown, the upper dome 28 has an opening or slot 120 adapted to receive the guide member 118. The dome 28 is preferably fitted onto the shell frame 42 so that the guide member 118 fits within the slot 120. Snap-on latches 144 are shown on the frame 42, for retaining the dome 28 thereon. The illustrated guide member 118 has a spherical portion 130 having a guide aperture 128. Preferably, a coil spring 132 is provided inside of the spherical portion 130 to dampen recoil from drawing in a hose up to the nozzle.

The aperture 128 is sized and configured to permit a linear material, such as a hose, cable, rope, fishing line or wire, to pass through it as the linear material is drawn into the reel 20 and spooled onto the drum 36. Preferably, the aperture 128 is no more than about twice as wide as it is high, and is more preferably substantially symmetrical (e.g., circular rather than an elongated slot). Thus, the aperture 128 can be sized to just fit the linear material therethrough with clearance to avoid friction in winding/unwinding. In contrast to typical "enclosed" reels with reciprocating mechanisms, which tend to have elongated slots for the reciprocating mechanism to translate across, a child cannot reach inside the shell during operation. Reference is made to U.S. Pat. No. 4,832,074 for an exemplary prior art hose reel shell with an elongated slot 4 opening.

Figure 9:
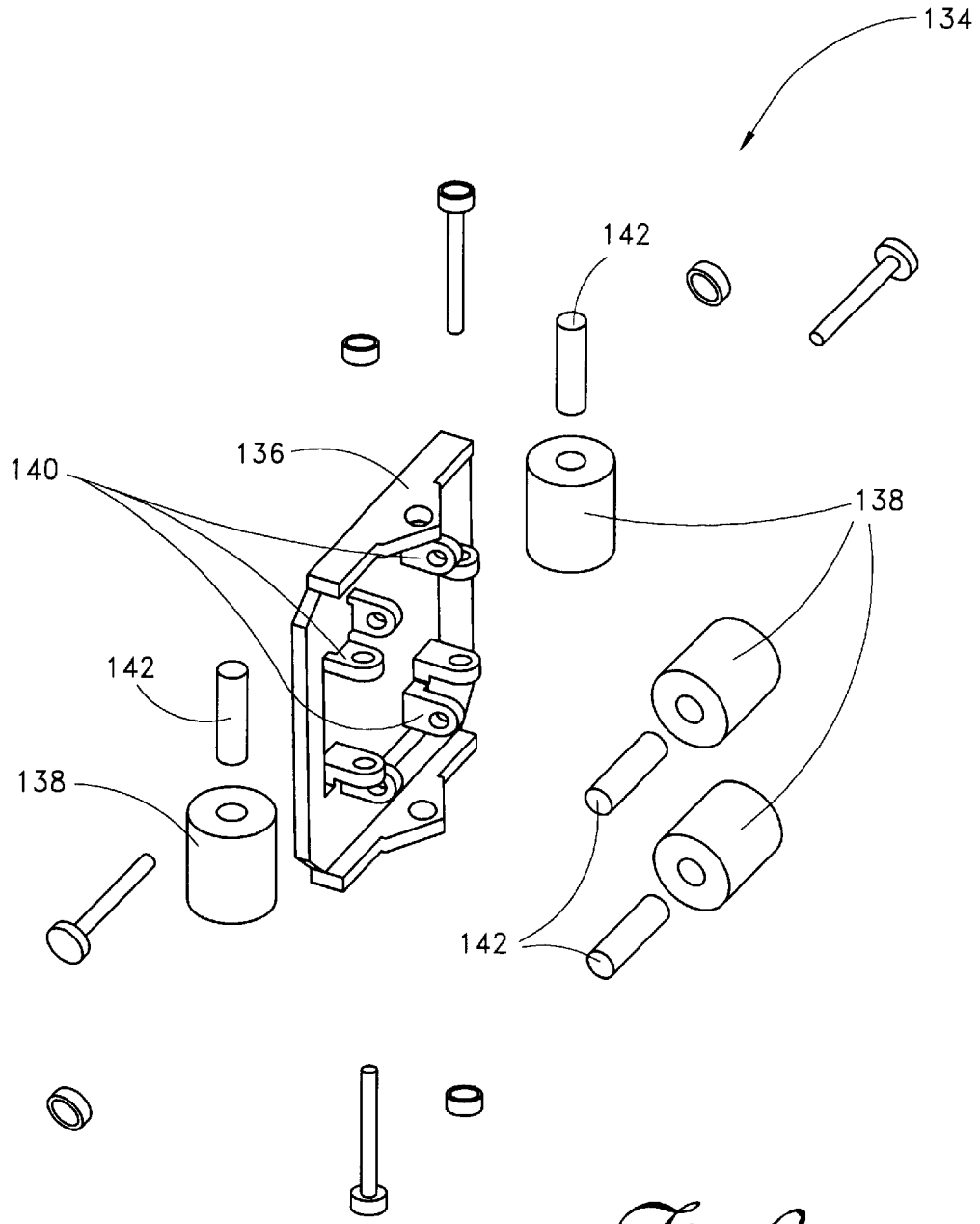
FIG. 9 is an exploded perspective view of the roller assembly of the upper shell portion shown in FIG. 5.
Figure 10:
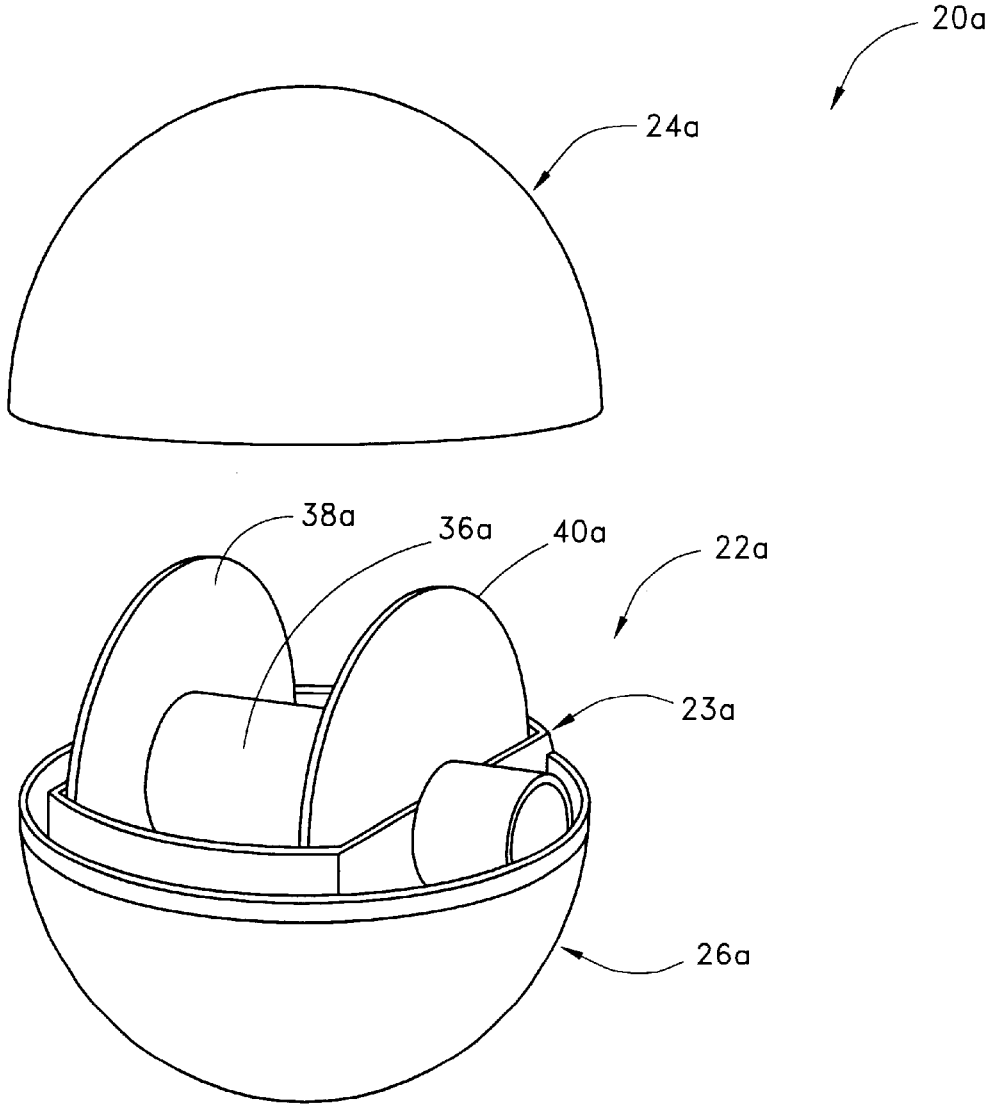
FIG. 10 is a perspective view of a reel constructed in accordance with another embodiment of the present invention, shown with an open housing revealing a drum and frame.
Figure 11:
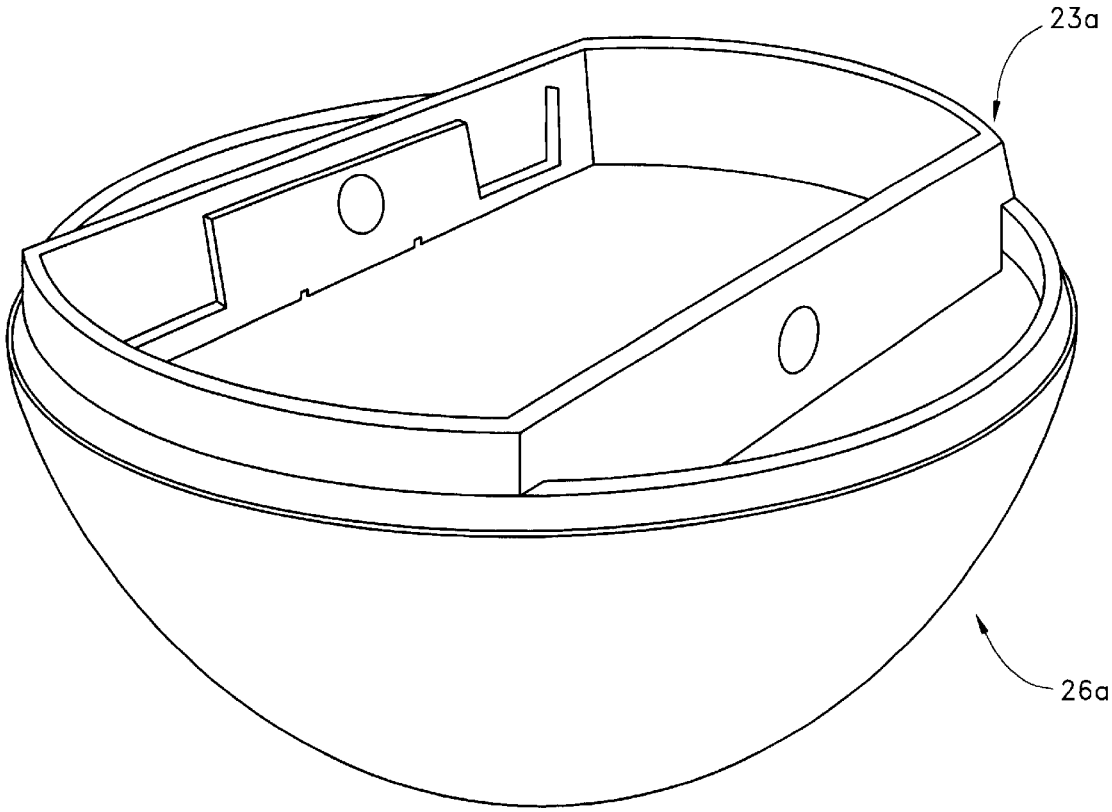
FIG. 11 is a perspective view of the bottom shell and frame of FIG. 10.
Figure 12:
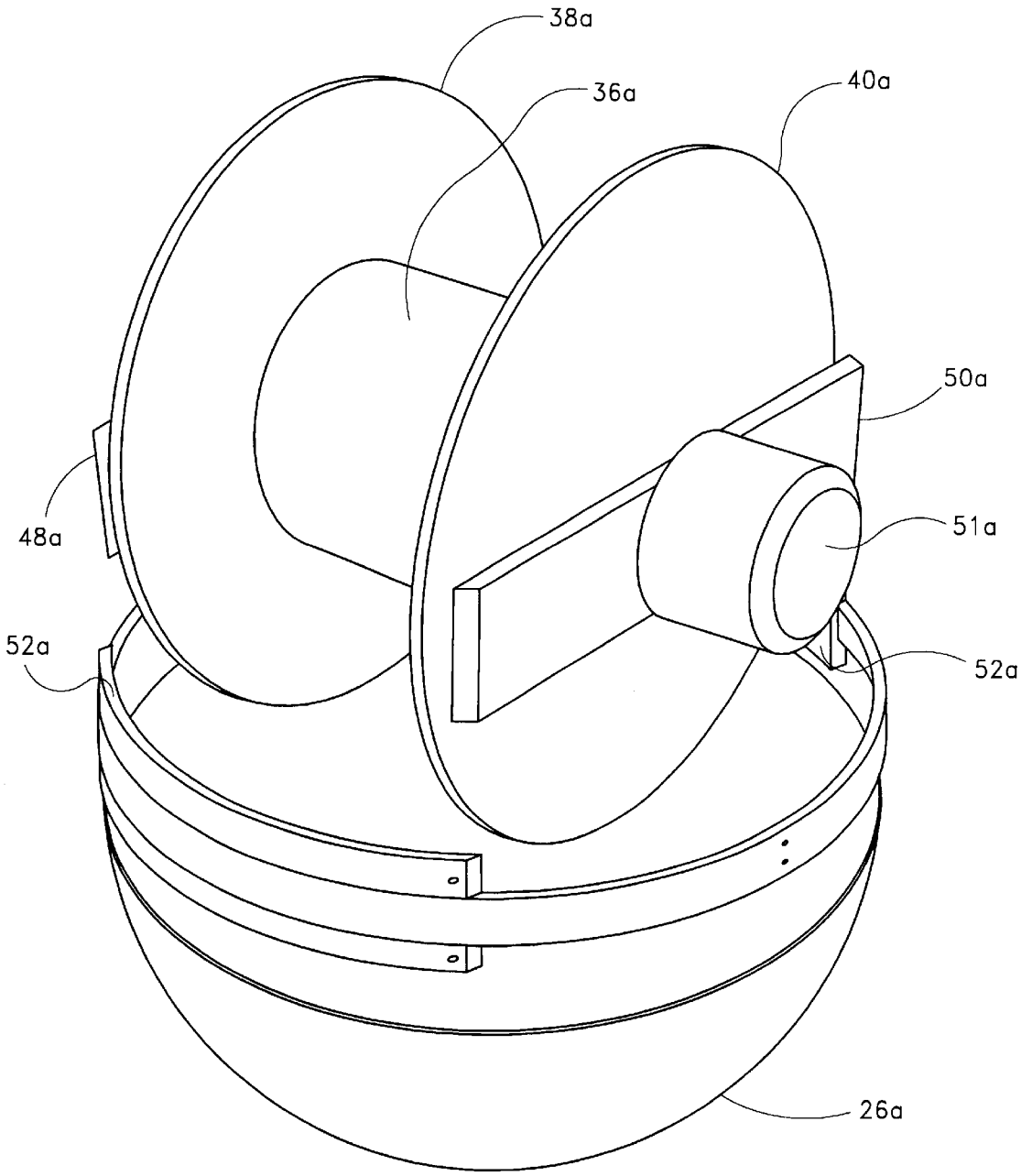
FIG. 12 is an exploded perspective view, showing a bottom shell, unassembled frame components and drum of the reel of FIG. 10.
Figure 13:
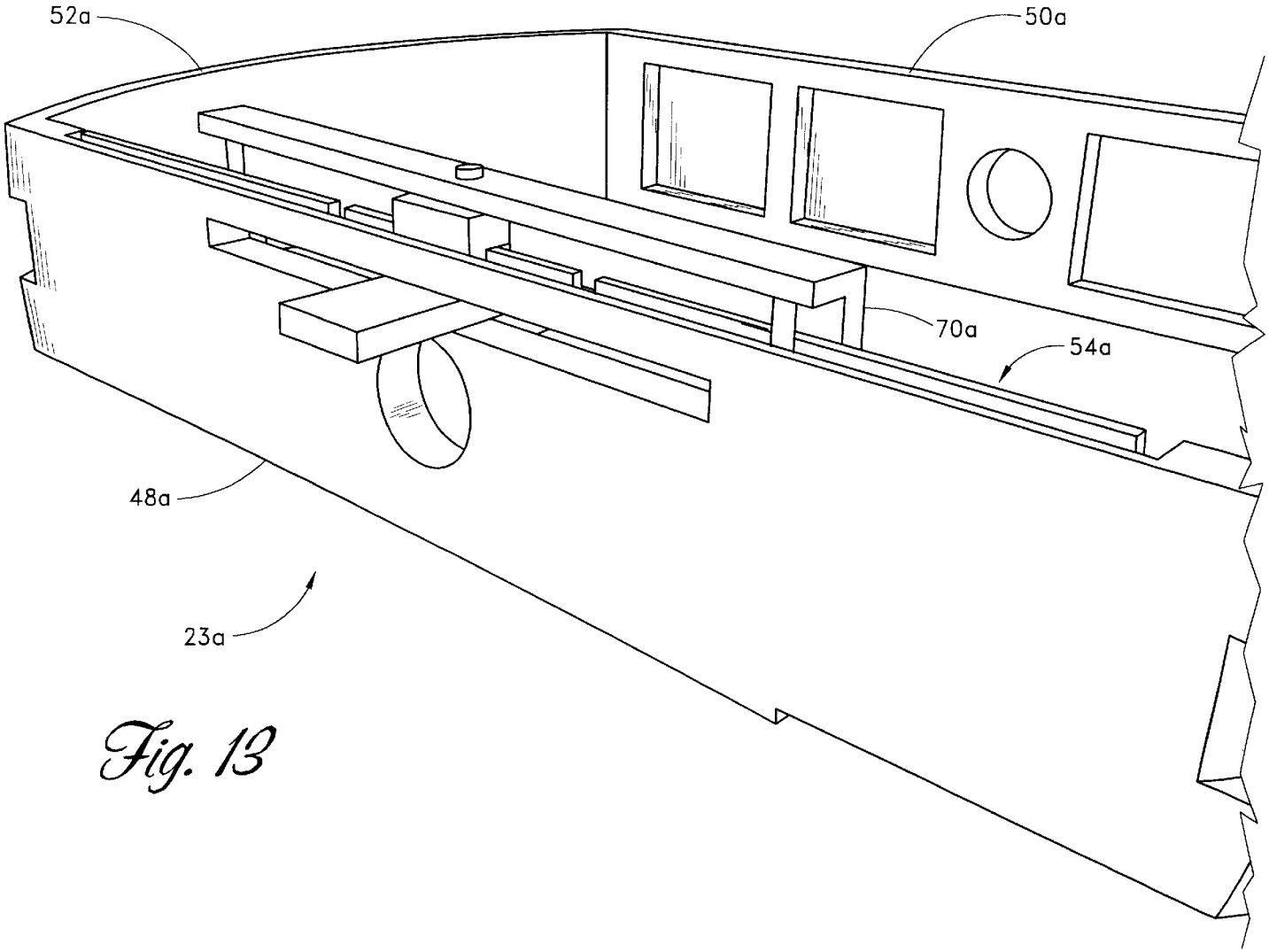
FIG. 13 is a perspective outer view of the frame of FIG. 10, having an integral track, and a translating plate engaged with the track.
Figure 14:
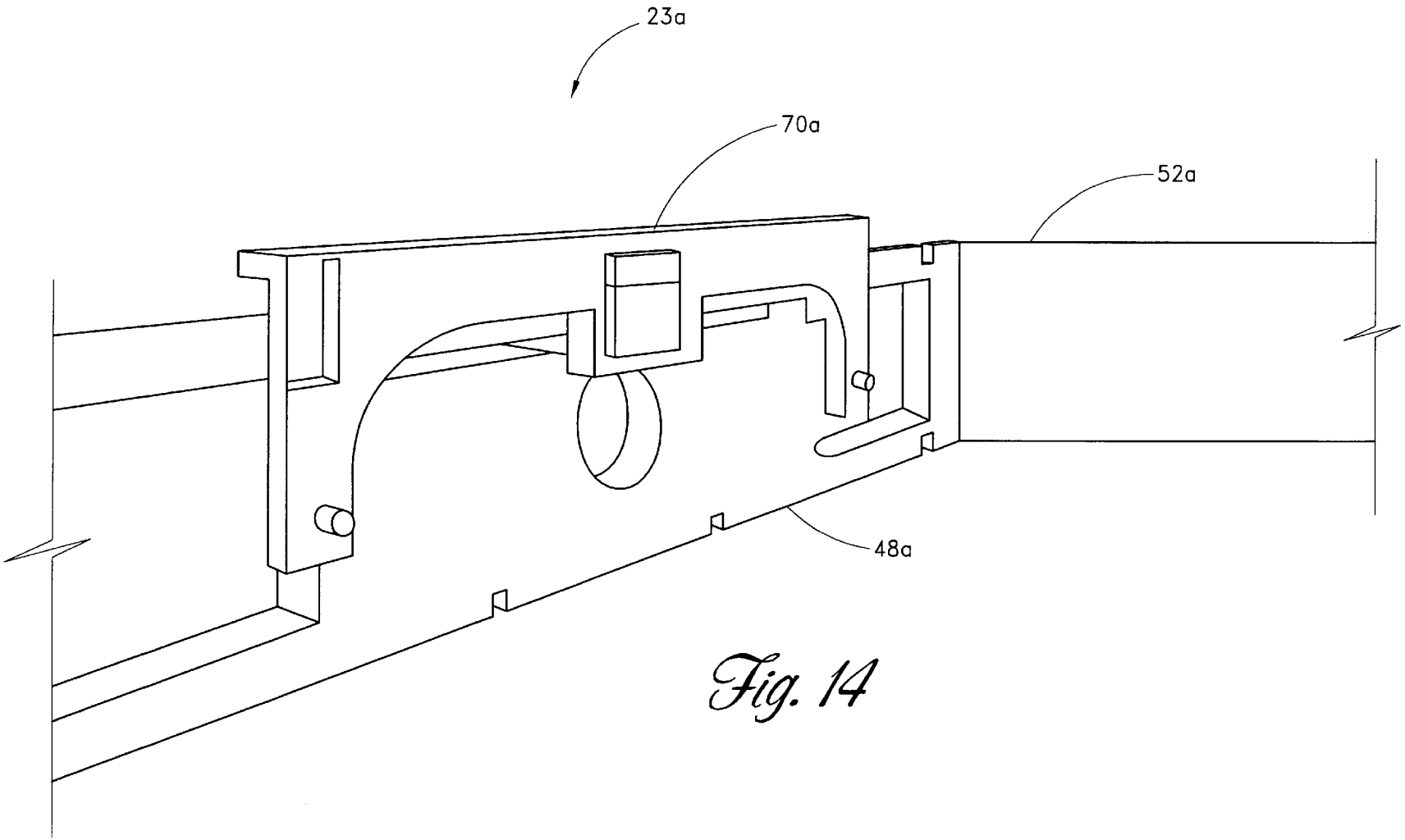
FIG. 14 is a perspective inner view of the frame of FIG. 10, showing the translating plate.
Figure 15:
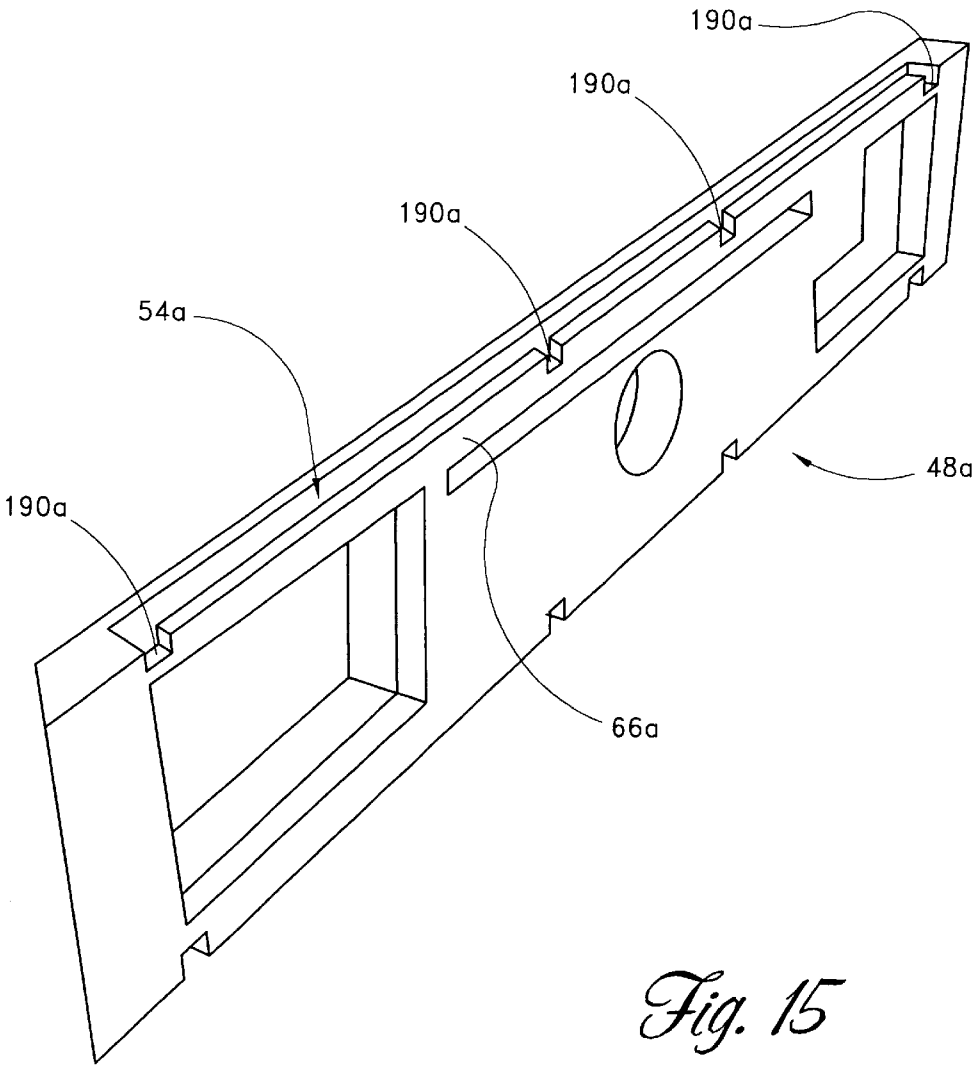
FIG. 15 is an inner and top perspective view of a member of the frame of FIG. 10, having an integral slot formed in a top surface thereof.

Shown more clearly in FIG. 9, a roller assembly 134 is preferably provided to reduce frictional effects as linear material (e.g., a garden hose) is drawn inward through the guide member 118. The roller assembly 134 comprises a plate 136 having a central orifice for the linear material to pass through as it is drawn to the drum 36, and one or more (preferably four) rollers 138 secured onto the plate 136. In the illustrated embodiment, rod supports 140 are attached to the plate 136. The rod supports 140 house the ends of rods 142 which support the rollers 138. The roller assembly 134 is securely positioned within the guide member 118, inside of the spherical portion 130.

Referring again to FIG. 1, in operation, the reel 20 of the present invention includes a reciprocating mechanism that generates reciprocating rotational motion of the upper shell portion 24 with respect to the drum assembly 22. In particular, during rotation of the drum 36, the upper shell portion 24 rotates back and forth through a partial rotation. The guide member 118 (FIG. 5) of the upper shell portion is configured to receive a linear material intended to be spooled onto the drum 36. During rotation of the drum 36, the guide member 118 (and the guide aperture 128 therein) reciprocatingly translates through an arc in front of the drum as a result of the back and forth rotation of the upper shell portion 24, caused by the reciprocating mechanism described below herein. Advantageously, the guide member 118 splays the linear material across the width of the drum 36 as the linear material is spooled thereon.

Figure 6:
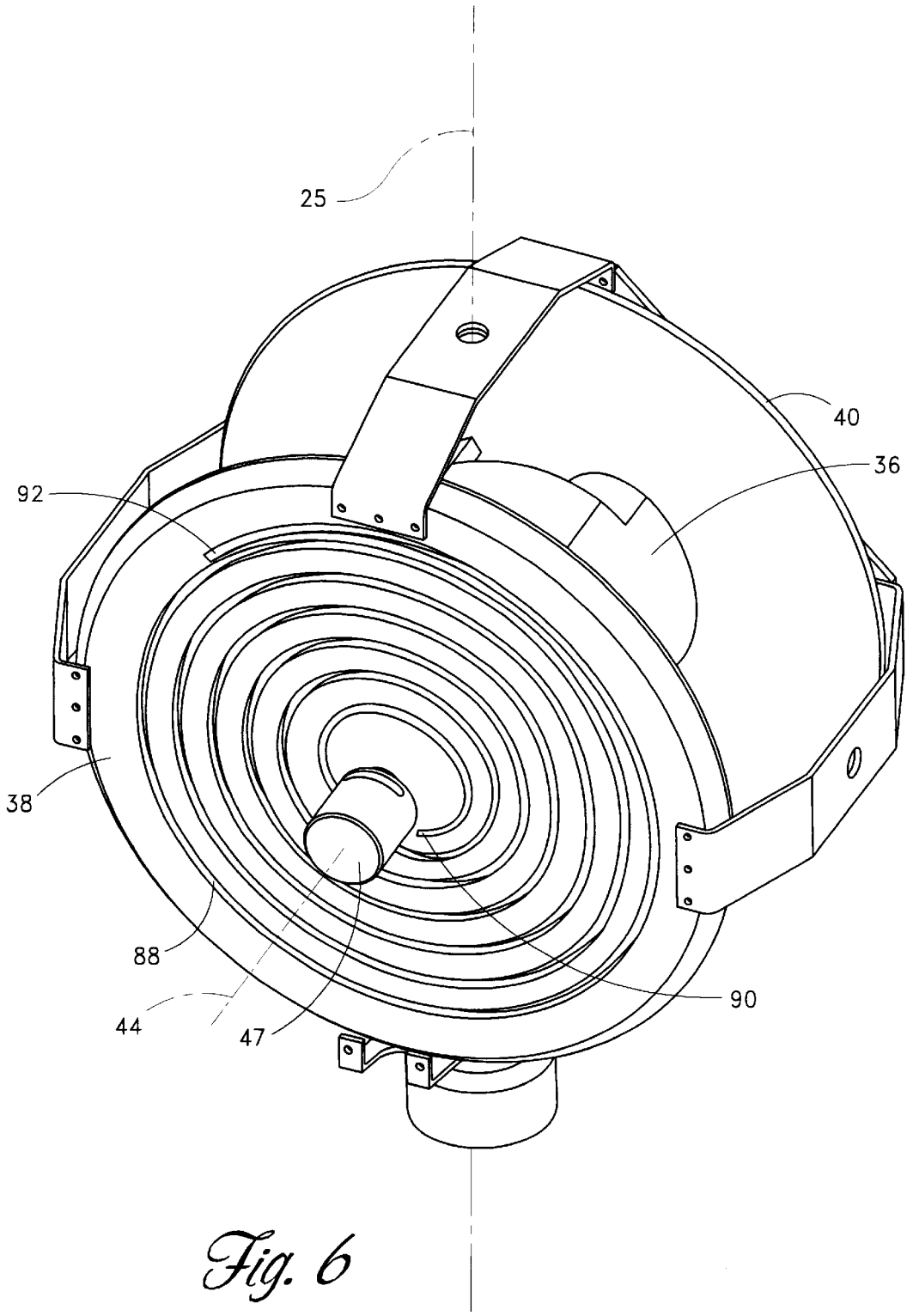
FIG. 6 is a rear perspective view of an inner portion of the drum assembly of the reel of FIG. 1, including portions of the frame subassembly.
Figure 7:
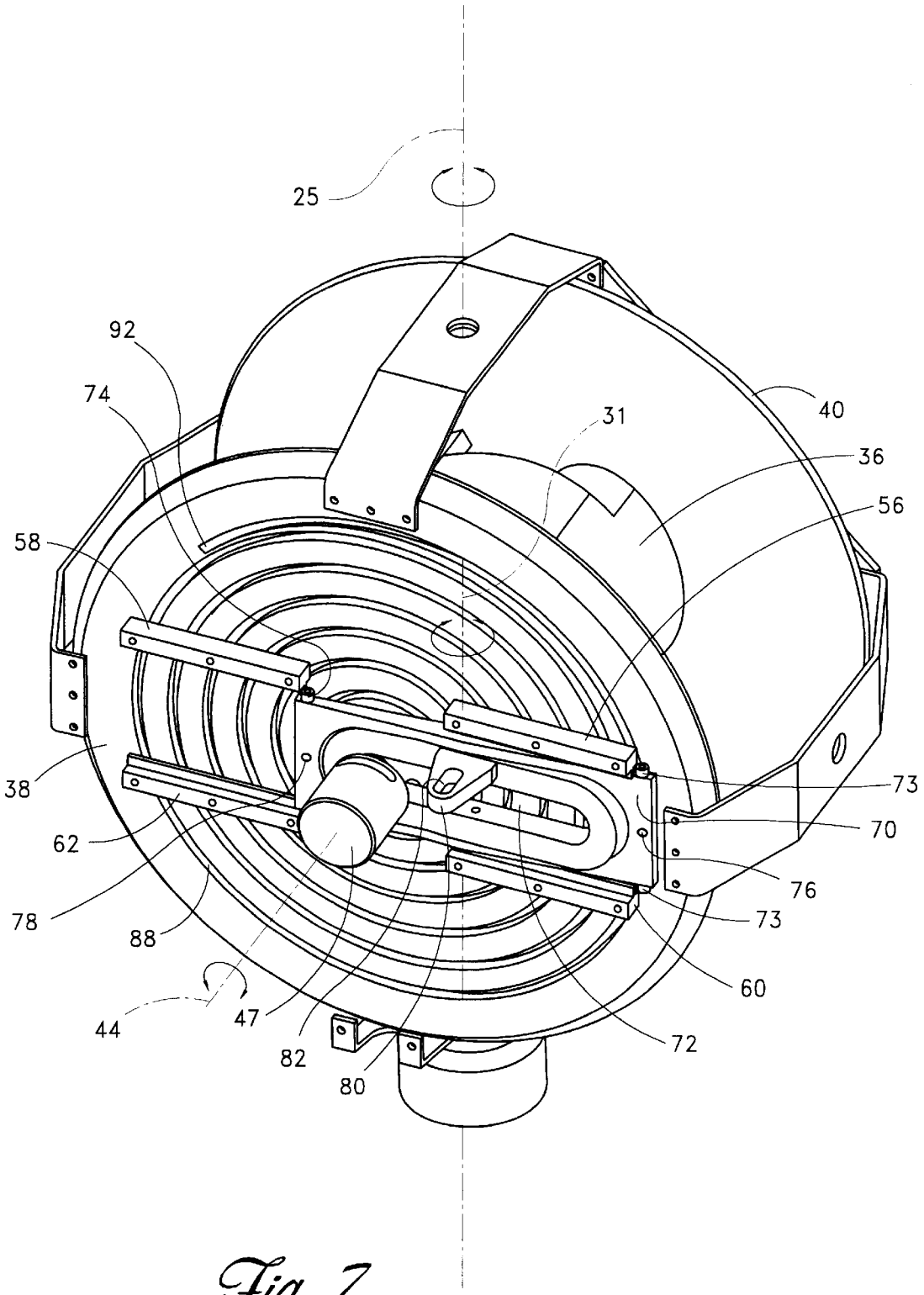
FIG. 7 is a rear perspective view of the drum assembly of FIG. 1, with portions of the frame assembly, including the track assembly and translating plate shown.

FIGS. 6 and 7 illustrate a preferred reciprocating mechanism for creating the above-described back and forth rotation of the upper shell portion 24 as the drum 36 rotates. Preferably, a spiral groove 88 is provided on the outer surface of one of the discs 38, 40 (FIG. 2) of the drum assembly 22. In the illustrated embodiment, the spiral groove 88 is on the outer surface of the disc 38. The groove 88 spirals about the center of the disc 38, which is aligned with the axis of rotation 44 of the drum 36 and the discs 38, 40. The groove 88 has a first or inner end 90 (FIG. 6) and a second or outer end 92. The first end 90 is nearer to the center of the disc 38 than is the second end 92. The illustrated first end 90 is near the center of the disc 38 and the second end 92 is near the outer edge of the disc 38. The depth of the groove 88 tapers to a lesser depth at at least one end and preferably at each of the first end 90 and the second end 92. Preferably, the groove depth tapers to zero at each of the first end and the second end 92. The groove depth may be uniform throughout the length of the groove 88, with the exception of the tapering at the second ends 90, 92.

According to a preferred embodiment of the invention, the member 70 advantageously translates in a reciprocating or back and forth manner across the surface of the disc 36. Referring to FIG. 7, the drum assembly 22 is configured so that the member 70 translates horizontally within the track defined by the track members 56, 58, 60, and 62 of the track assembly 54 of the frame subassembly, in the illustrated embodiment attached to the inner surface of the side plate 48 (see FIG. 3). The side plate 48 and the disc 38 are spaced apart a distance such that when the vertical pins 73 or 74 at one end of the translating member 70 are engaged within the tracks of the track assembly 54, one of the horizontal pins 76 or 78 at the other end of the translating member 70 is engaged within the spiral groove 88. As the drum 36 and discs 38, 40 rotate together, the rotating spiral groove 88 pulls the engaged horizontal pin 76 or 78 horizontally, causing the translating member 70 to translate across the disc 36, within the track assembly 54. Optionally, the pins 76 and 78 can be configured to rotate with respect to the translating member 70. This permits the pins 76 and 78 to rotate against the side walls of the groove 88 as the disc 38 rotates, thereby minimizing friction and wear of the pins. The skilled artisan will appreciate that an appropriate choice of materials can also facilitate minimum wear while permitting the pins to slide 76, 78 within the groove 88.

Preferably, the drum 36 is rotated in a direction such that the engaged pin 76 or 78 is pulled toward one of the right and left sides of the disc 38. This causes the engaged pin to reach either the inner end 90 or the outer end 92 of the groove 88. The tapered configuration of the ends 90, 92 forces the engaged pin out of the groove 88. Simultaneously, the translating member 70 pivots about its translating pivot axis 31 (shown in FIGS. 3 and 7) at the thicker central portion 71, causing the other of the horizontal pins 76, 78 (on the other side of the translating member 70) to engage the groove 88 at or near the other end 90, 92 thereof and on the other side of the axis 44 of rotation. Then, the newly engaged pin is pulled horizontally in an opposite direction in the same manner.

To illustrate the translational cycle produced by the reciprocating mechanism of the invention, with reference to FIG. 7, suppose the horizontal pin 76 (the back of which is shown at the right side of the translating member 70 in FIG. 7) is engaged within the spiral groove 88, at or near the inner end 90 thereof, on the right side of the drum axis of rotation 44. The tapered configuration of the translating member 70 is such that when the right pin 76 is engaged within the groove 88, the left pin 78 (the back of which is shown on the left side of the translating member 70 in FIG. 7) is disengaged from the groove 88. Also, the vertical pins 74 are engaged within the tracks formed by the track members 58 and 62. In the illustrated embodiment, the drum 36 preferably rotates in a clockwise direction, so that when the right pin 76 is engaged in the groove 88 on the right side of the drum axis 44, the translating member 70 is pulled toward the right side of the disc 38. Thus, as drum 36 rotates clockwise, the engaged pin 76 is pulled horizontally to the right, toward the outer edge of the disc 38. This causes the translating member 70 to translate horizontally to the right. The pins 74 simultaneously translate within the tracks of the track assembly 54. The engagement of the pins 74 within the track assembly 54 prevents the pin 76 from becoming disengaged from the groove 88.

Eventually, the right pin 76 reaches the outer end 92 of the groove 88. At this point, the vertical pins 73 are positioned beyond the outer ends of the track members 56 and 60, and the vertical pins 74 are positioned beyond the inner ends of the track members 58 and 62. The tapered groove depth at the outer end 92 forces the right horizontal pin 76 out of the groove 88. As the right pin 76 disengages from the groove 88, the translating member 70 pivots about its pivot axis 31. This causes the other pin 78 to engage the groove 88 at or near the inner end 90, but on the other side of the drum axis 44. Simultaneously, the vertical pins 73 rock outward and become aligned with the tracks formed by the track members 56 and 60, and the vertical pins 74 rock inward toward the disc 38 so that they are not aligned with the tracks formed by the track members 58 and 62. The continued clockwise rotation of the drum 36 causes the pin 78 to be pulled horizontally toward the outer edge of the disc 38 in a similar manner. In particular, the left pin 78 is pulled to the left this time, but again to the outer end 92 of the groove 88, during which time the pins 73 translate within the tracks formed by the track members 56 and 60. When the pin 78 reaches the outer end 92, it is forced out of the groove 88 due the tapered groove depth at the inner end 90. This causes the translating member 70 to pivot back, about its pivot axis 31, such that the right pin 76 engages the groove 88, at or near the inner end 90, on the right side of the drum axis 44. Simultaneously, the pins 74 rock outward and become aligned with the tracks formed by the track members 58 and 62, and the pins 73 rock inward toward the disc 38. The cycle is then repeated. In this manner, the member 70 translates horizontally back and forth as the drum 36 rotates, due to the reciprocating mechanism of the reel 20.

The skilled artisan will readily appreciate that when the drum is rotated in the opposite direction (counter-clockwise), the operation is similar, except that the pins are forced out at the inner end 90. Thus, for the illustrated embodiment, the tapered outer end 92 of the spiral groove 88 can operate to cause change in the direction of translation during winding of hose or other linear material, whereas the tapered inner end 90 can operate to cause change in the direction of translation during unwinding of the hose or other linear material. Put another way, in this example the engaged pin is always pulled to the outer end of the spiral (whether the plate is translating right or left) during winding, and always to the inner end of the spiral during unwinding (whether the plate is translating right or left). It will of course be appreciated that the directions of winding and unwinding can be reversed if desired, and that the spiral can be given an opposite orientation if desired.

According to a preferred embodiment of the invention, a linkage is provided between the upper shell portion 24 and the translating member 70 to convert the abovedescribed reciprocating translation of the translating member 70 into reciprocating rotation of the upper shell portion 24. Referring to FIG. 2, the shell frame 42 has an inwardly extending portion 94, which has a downwardly extending vertical pin 96. The pin 96 is sized to be received within the slot 82 of the arm 80 that extends from the translating member 70 (FIG. 3). As the member 70 translates horizontally, the engagement between the pin 96 of the upper shell portion 24 and the slot 82 of the translating member 70 causes the upper shell portion to rotate about the shell axis 25, with respect to the lower shell portion 26. Moreover, the upper shell portion 24 reciprocatingly rotates through only a partial rotation, due to the reciprocating translation of member 70.

In use, a linear material is drawn into the reel 20 through the aperture 128 of the guide member 118 (FIG. 5) and then spooled onto the rotating drum 36. Advantageously, guide member 118 reciprocates through an arc generally in front of the drum 36, so that the linear material is spooled across the spool surface 37 of the drum 36 as it winds. Preferably, the dimensions of the spiral groove 88 are arranged, relative to the size of the cylinder 36, such that the linear material is spooled substantially uniformly onto a length of the spool surface 37.

Figure 8A:
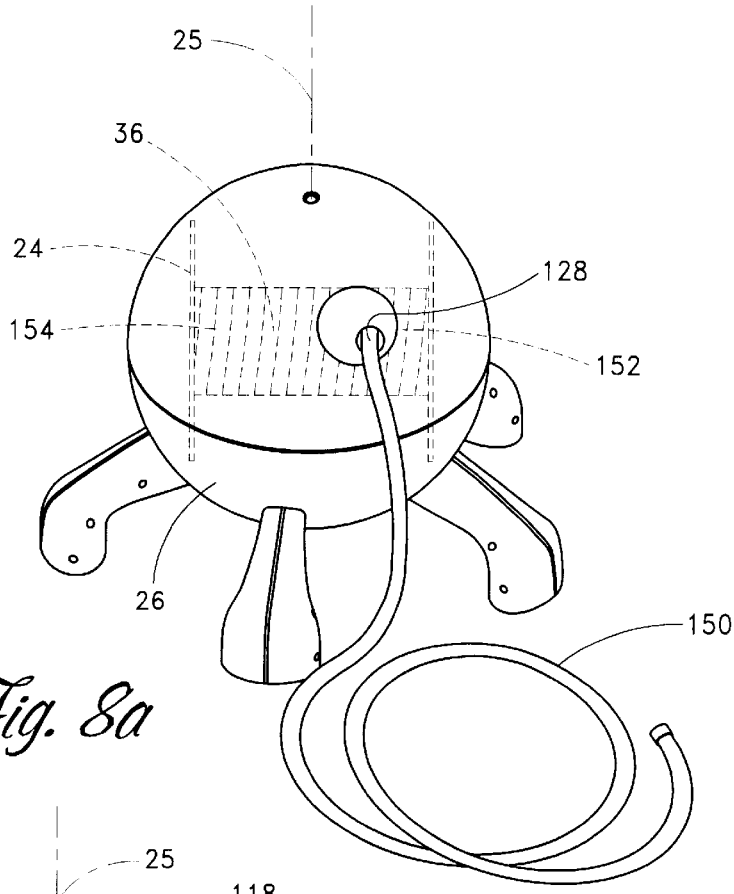
FIGS. 8A and 8B are perspective views of the reel of FIG. 1, illustrating two positions in the reciprocating rotation of the upper shell portion of the reel.
Figure 8B:
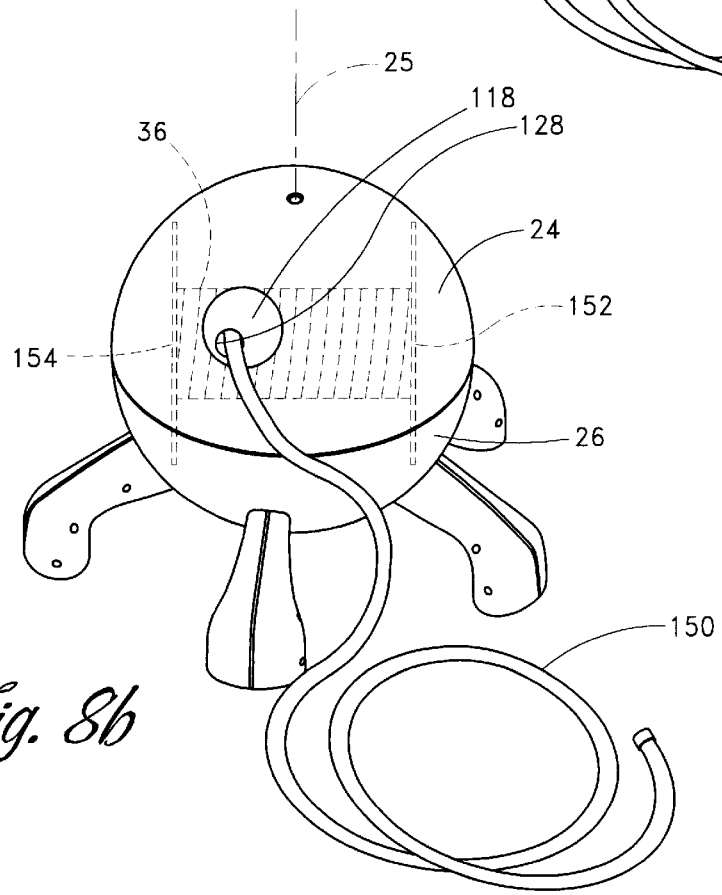

FIGS. 8A and 8B illustrate this concept. In FIG. 8A, the upper shell portion 24 occupies a first position in which the aperture 128 in the guide member 118 is located near a first end 152 of the drum 36 housed within the shell 24, 26. In this position, linear material 150 is spooled onto the drum 36 near the first end 152. As the motor-driven drum 36 rotates, at least the upper shell portion 24 gradually rotates about the shell axis 25 toward a second position shown in FIG. 8B, due to the abovedescribed reciprocating mechanism of the invention. In FIG. 8B, the aperture 128 is located near a second end 154 of the drum 36. As the upper shell portion 24 rotates to the second position, the aperture 128 moves through an arc in front of the drum 36. As the aperture 128 translates across the drum 36, the linear material 150 is advantageously distributed substantially uniformly across its surface. When the aperture 128 reaches the second position shown in FIG. 8B, the linear material is spooled onto the drum 36 near the second end 154. Then, the upper shell portion 24 begins to rotate back toward the first position shown in FIG. 8A. In this manner, the guide aperture 128 makes repeated passes across the drum 36, so that multiple layers of linear material 150 may be spooled uniformly thereon.

Those skilled in the art will appreciate that the benefits of the invention are achieved by producing relative reciprocating motion between the aperture 128 and the drum assembly 22. In the illustrated embodiment, the relative motion is achieved by the spiral groove mechanism. In other arrangements, such motion may be achieved in a variety of ways, such as with a reversing or traversing screw. For example, the reversing screw of U.S. Pat. No. 4,513,772, issued Apr. 30, 1985 to Fisher can be used to link rotation of the drum about the drum axis 44 to rotation of the shell 24, 26 about the shell axis 25. The disclosure of U.S. Pat. No. 4,513,772 to Fisher is incorporated herein by reference.

Additionally, in the preferred embodiment, the upper shell portion 24 and drum assembly 22 reciprocatingly rotate relative to one another while one or both of the elements 22, 24 preferably rotate freely with respect to the lower shell portion 26. Advantageously, this allows a user to walk freely about the reel 20 with the linear material in hand while the drum assembly 22 and the upper shell portion 24 freely rotate with respect to the lower shell portion 26 to avoid entanglement. For example, if the user walks in a circle around the reel 20, the upper shell portion 24 and the drum assembly 22 will rotate 360° with respect to the lower shell portion 26. At the same time, the upper shell portion 24 and the drum assembly 22 will maintain the above-described reciprocating rotation with respect to each other. In other arrangements, it will be understood that the entire shell 24, 26 and drum assembly 22 can rotate as a unit 360° about the shell axis 25 (e.g., about an axial bottom stand or wheeled frame) while allowing relative rotation between the drum assembly 22 and at least the portion of the shell defining the aperture 128.

Other arrangements of the reel 20 are possible. For example, the reel 20 can be operated while maintaining the lower shell portion 26 and the drum assembly 22 fixed with respect to a lower support surface, as described in FIGS. 8A and 8B. In this case, the upper shell portion rotates reciprocatingly with respect to the lower support surface. It will also be appreciated that the reel 20 can be arranged to operate while maintaining the upper shell portion 24 fixed with respect to a support surface, in which case the drum assembly 22 rotates reciprocatingly with respect to the support surface. The legs 34 can be provided with wheels to facilitate rotation of the lower shell portion and the drum assembly against a lower support surface. In one embodiment, the reel 20 is hung by attaching the upper shell portion 24 to an upper support surface. In this mode of operation, linear material is drawn into the reel 20 through the aperture 128 which is positionally fixed with respect to the support surfaces. In any case, the linear material is advantageously uniformly spooled onto substantially all of the spool surface 37 of the drum 36, due to the relative motion between the drum assembly 22 and the upper shell portion 24.

Those skilled in the art will understand that, for certain aspects of the invention, it is not necessary that the shell completely enclose the drum assembly 22. Also, the reel 20 can be used to wind or unwind linear material onto the drum 36. In addition, those skilled in the art will understand that other reciprocating mechanisms can be used in place of the one described above, including various other spiral groove configurations. For example, the plate 38 need not be coaxial with the drum 36 but can instead be rotationally linked by one or more gears. Further, in the illustrated spiral groove embodiment, it is not necessary that the entire upper shell portion 24 rotate with respect to the lower shell portion 26. The benefits of the invention are achieved if, for example, only a portion of the upper shell portion 24 that includes the aperture 28 reciprocatingly rotates with respect to the drum assembly 22.

In another embodiment, a hand crank may be provided in place of or in addition to the motor 51, to manually rotate the drum 36 and the discs 38, 40. The hand crank can extend through an opening in the lower shell portion, so that it does not impede rotation of the upper shell portion. Alternatively, the hand crank can extend through a horizontal slot in the upper shell portion. A gear assembly can be provided to permit a more convenient vertical position of the hand crank and to facilitate faster, easier rotation of the drum.

The skilled artisan can readily select suitable materials for each of the components. In a preferred embodiment, the hemispherical domes 28 and 32 and the frame 42 are molded and formed from PVC. The discs 38, 40 can be molded from high impact styrene or other injection molded plastic. The drum 36 and the discs 38, 40 may be formed separately or integrally, as desired. The side plates 48, 50 and the connection supports 52 are preferably formed from sheet metal, such as aluminum, and similarly for the track members 56, 58, 60, 62. The track members 56, 58, 60, and 62 can be formed separately or integrally with respect to the side plate 48, as desired. The translating member 70 is preferably formed of plastic. The base connection member 86 is preferably molded and formed from acetal. Any of a variety of commercially available motors may be used as the motor 51. Revcor, Inc. of Halton City, Tex. sells a suitable motor as part number #60036 (12 V). Those skilled in the art will understand that any of a wide variety of suitable materials and components can be used to achieve the advantages taught herein, the present invention not being limited to any of the materials or components specifically mentioned above.

FIGS. 10–15 illustrate another embodiment of the present invention, wherein parts similar to those of the previous embodiment are referenced by like numerals, with the addition of the suffix "a". In the illustrated embodiment, the construction of the frame 23*a*, track 54*a* and bearing members for connecting the reel 20*a* in rotary fashion to the shell 24*a*, 26*a* is greatly simplified, relative to the previously described embodiment. For example, the frame subassembly 23*a* is formed from four parts 48*a*, 50*a*, 52*a*, 52*a* that can be readily screwed or bolted together during assembly, as apparent from FIG. 12. Additionally, the frame subassembly 23*a* includes an integrally formed track 54*a* in which extensions from the translating plate 70*a* can slide, including four slots 190*a* permitting entry and exit of the extensions (e.g., vertical pins).

The skilled artisan will appreciate that the embodiment of FIGS. 10–15 can operate substantially as described above with respect to the previous embodiment. In addition to simplifying the frame construction, bearing surfaces between the shell portions can be simplified by use of a low friction interface in the form of a plastic ring between the shell components.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

I claim:

1. A reciprocating mechanism, comprising:

a plate adapted to rotate about a first axis, the plate having a spiral groove spiraling about the first axis; and a translating member having first and second groove engagement portions being configured to selectively engage the groove;

wherein the translating member is configured so that, during rotation of the plate about the first axis, the groove engagement portions alternately engage the groove on opposite sides of the first axis, causing the translating member to translate linearly back and forth as the plate rotates in one rotary direction about the first axis.

2. The reciprocating mechanism of claim 1, wherein the spiral groove has an inner end and an outer end, the first axis being nearer to the inner end than to the outer end, the depth of the groove tapering to lesser depth at one of the ends.

3. The reciprocating mechanism of claim 2, wherein the spiral groove tapers to lesser depth at each of the inner end and the outer end.

4. The reciprocating mechanism of claim 3, wherein the groove engagement portions are alternately pulled to the outer end of the spiral groove when the plate rotates clockwise, and are alternately pulled to the inner end of the spiral groove when the plate rotates counterclockwise.

5. The reciprocating mechanism of claim 3, wherein the groove engagement portions are alternately pulled to the outer end of the spiral groove when the plate rotates counterclockwise, and are alternately pulled to the inner end of the spiral groove when the plate rotates clockwise.

6. The reciprocating mechanism of claim 2, wherein the translating member is configured to translate in a first linear direction when the first groove engagement portion is engaged with the groove on a first side of the first axis and when the first plate rotates in the one rotary direction about the first axis.

7. The reciprocating mechanism of claim 6, wherein the translating member is arranged to pivot about a central axis between the first groove engagement portion and the second groove engagement portion when the first groove engagement reaches the tapered end.

8. The reciprocating mechanism of claim 7, wherein the translating member is arranged to insert the second groove engagement portion into the groove on a second side of the first axis when the translating member pivots as the first groove engagement portion reaches the tapered outer end, the second side being opposite to the first side, the translating member being configured to translate in a second linear direction when the second groove engagement portion is engaged with the groove and the plate continues to rotate in the one rotary direction about the first axis, the second linear direction being opposite to the first linear direction.

9. The reciprocating mechanism of claim 1, wherein the first groove engagement portion comprises a first pin, the second groove engagement portion comprising a second pin.

10. The reciprocating mechanism of claim 1, further comprising a generally linear track being positioned generally parallel to the plate, the translating member having a track engagement portion configured to engage and translate along the track during linear translation of the translating member.

11. The reciprocating mechanism of claim 1, forming a part of a reel for winding and unwinding linear material.

12. The reciprocating mechanism of claim 11, wherein the first plate rotates along with a reel drum configured to receive the linear material thereabout, the reel drum and the plate configured to rotate together about the first axis.

13. The reciprocating mechanism of claim 12, wherein the reel further comprises:

a housing substantially surrounding the plate, the translating member, and the reel drum, at least a portion of the housing configured to rotate about a second axis, the portion of the housing including a guide aperture configured to guide linear material onto the reel drum; and a linkage between the translating member and the housing, the linkage configured to convert linear translation of the translating member into reciprocating rotation of the portion of the housing about the second axis.

14. The reciprocating mechanism of claim 13, wherein the second axis is substantially orthogonal to the first axis.

15. The reciprocating mechanism of claim 14, wherein the linkage comprises:

an arm extending from the translating member, the arm having a bore extending through a portion of the arm; and a pin extending from the housing, the pin being received within the bore in the arm.

16. A reel comprising:

a drum configured to rotate about a drum axis and to receive linear material being wrapped around a spool surface of the drum as the drum rotates about the drum axis;

a shell substantially surrounding the drum; and a reciprocating mechanism configured to reciprocatingly rotate at least a portion of the shell with respect to the drum about a shell axis, the portion of the shell having an aperture which reciprocates through an arc across the spool surface as the portion of the shell reciprocatingly rotates about the shell axis.

17. The reel of claim 16, wherein the reciprocating mechanism links continued rotation of the drum about the drum axis with reciprocating rotation of the portion of the shell about the shell axis, the shell axis being orthogonal to the drum axis.

18. The reel of claim 16, wherein the reciprocating mechanism comprises:

a plate connected to rotate with the drum together about the drum axis, the plate having a groove spiraled about the drum axis; and a translating member having first and second groove engagement portions configured to engage the groove, the translating member configured so that, during rotation of the drum and the plate about the drum axis, the groove engagement portions are pulled to one end of the groove, alternately engage the groove on opposite sides of the drum axis and causing the translating member to translate linearly reciprocatingly along a line as the plate continually rotates in one rotary direction about the drum axis.

19. The reel of claim 16, wherein the reciprocating mechanism comprises a reversing screw.

20. The reel of claim 16, wherein the shell substantially encloses the drum.

21. The reel of claim 20, wherein the aperture has a width measured generally parallel to the drum axis and a height, the width being no more than about twice the height.

22. A reel comprising:

a shell having an aperture, the shell adapted to rotate about a shell axis; and a drum housed within the shell, the drum adapted to rotate about a drum axis to receive a spool of linear material around a spool surface of the drum as the drum rotates;

a first element engaged with the drum, the first element having a spiral groove in a surface thereof;

a second element slidingly engaged with a track within the shell, the second element having first and second groove engagement portions configured to selectively engage the spiral groove; and a linkage between the second element and the shell; wherein the reel is configured so that during rotation of the drum about the drum axis:

the first element rotates;

the groove engagement portions alternately engage the groove on opposite sides of the first axis, causing the second plate to reciprocatingly and linearly translate within the track line as the first element rotates; and the linkage converts the reciprocating and linear translation of the second element into reciprocating rotation of the shell about the second axis, causing the aperture to reciprocatingly translate through an arc in front of the drum, the aperture translating such that linear material is guided through the aperture and distributed across the spool surface during drum rotation.

23. The reel of claim 22, wherein the groove has an inner end and an outer end, the depth of the groove tapering at each of the inner and outer ends.

24. The reel of claim 22, wherein the first groove engagement portion comprises a first pin, the second groove engagement portion comprising a second pin.

25. A reel comprising:

a drum having a spool surface, the drum configured to wind linear material onto the spool surface as the drum rotates about a drum axis, the drum also configured to rotate about a shell axis; and a shell substantially surrounding the drum, the shell comprising:

a first shell portion configured to remain fixed with respect to a support surface; and a second shell portion adapted to rotate about the shell axis while the first shell portion is fixed with respect to the support surface, the second shell portion connected to the drum by a linkage allowing limited relative rotation about the shell axis, the drum and the second shell portion rotating together freely about the shell axis, the second shell portion having a guide aperture therethrough sized and shaped to allow linear material to be drawn through the aperture onto the spool surface of the drum.

26. The reel of claim 25, wherein the drum and second shell portion rotate freely 360° about the shell axis.

27. The reel of claim 25, wherein the aperture has a width measured parallel to the drum axis and a height, the width being no more than about twice the height.

28. The reel of claim 25, wherein the drum axis is substantially orthogonal to the shell axis.

29. The reel of claim 25, wherein the shell is substantially spherical, the first shell portion comprising a lower hemisphere of the shell, the second shell portion comprising an upper hemisphere of the shell.

30. A method of spooling linear material, comprising:

providing a drum and a shell around the drum, a portion of the shell having an aperture therethrough;

rotating the drum about a first axis;

reciprocatingly rotating the shell portion with the aperture about a second axis as the drum rotates about the first axis; and drawing linear material through the aperture to the drum as the drum rotates, the linear material being distributed across the spool surface by reciprocating rotation of the shell portion.

31. The method of claim 30, wherein rotating the drum axis comprises transferring drum rotation into reciprocating rotation of the shell portion.

32. The method of claim 31, wherein transferring comprises converting rotary motion of the drum to reciprocating linear translation of a translating member and converting reciprocating linear translation of the translating member into reciprocating arcuate translation of the shell portion.

33. The method of claim 32, wherein converting rotary motion of the drum to reciprocating linear translation of the translating member comprises:

engaging a first pin of the translating member with a spiral groove that rotates along with the drum, the first pin engaged with the spiral groove on a first side of the drum axis;

disengaging the first pin from the spiral groove when the pin reaches an end of the spiral groove;

engaging a second pin of the translating member with the spiral groove on a second side of the drum axis, the second side being opposite the first side; and confining the translating member to linear translation along a track.

34. The method of claim 33, wherein disengaging comprises ramping the first pin out of the end of the groove with a groove depth.

35. The method of claim 33, wherein disengaging and engaging comprise pivoting the translating member about an axis between the first and second pins.

36. A method of producing reciprocating motion, comprising:

providing a first plate adapted to rotate about a plate axis, the first plate having a spiral groove spiraling about the plate axis, the spiral groove having two ends, the depth of the spiral groove tapering to lesser depth at at least one of the ends;

provide a second plate having first and second groove engagement portions each adapted to selectively engage the spiral groove;

engaging the first engagement portion with the spiral groove on a first side of the plate axis;

rotating the first plate in one rotary direction about the plate axis;

pulling the first engagement portion in a first direction toward the tapered end of the spiral groove by the rotation of the first plate, causing the second plate to translate generally along a line in the first direction;

causing, by continued rotation of the first plate in the one rotary direction, the first engagement portion to be forced out of the spiral groove at the tapered end, whereby the second plate pivots so that the second engagement portion simultaneously engages the spiral groove on a second side of the plate axis, the second side being opposite to the first side;

pulling the second engagement portion in a second direction toward an outer edge of the first plate, by continued rotation of the first plate in the one rotary direction, causing the second plate to translate generally along a line in the second direction, the second direction being generally opposite to the first direction; and causing, by continued rotation of the first plate in the one rotary direction, the second engagement portion to be forced out of the spiral groove at the tapered end, whereby the second plate pivots so that the first engagement portion simultaneously re-engages the spiral groove on the first side of the plate axis.

37. The method of claim 36, wherein rotating the first plate in an opposite rotary direction to the one rotary direction about the plate axis causes the first and second engagement portions to alternately be forced out of a second of the two ends of the spiral groove, thereby alternately changing translation of the second plate between the first and the second directions.

38. The method of claim 36, wherein the tapered end comprises an outer end.

39. The method of claim 38, wherein each of an outer end and an inner end of the spiral groove are tapered, the second plate configured to linearly reciprocate with either clockwise or counter-clockwise rotation of the first plate.

40. The method of claim 36, further comprising linking the second plate to a guide member to cause reciprocating motion of the guide member in front of a spooling drum.

41. A method of spooling linear material, comprising the steps of:

providing a drum assembly comprising a disc and a drum, the disc and drum being linked to rotate about a drum axis, the disc having a spiral groove spiraling about the drum axis, the groove having a first end and a second end, the groove tapering to lesser depth at one of the first and second ends;

providing a translating member having first and second groove engagement portions each adapted to engage the groove;

providing a shell having an aperture and being configured to rotate about a shell axis;

providing a linkage between the translating member and the shell, the linkage being configured to convert linear motion of the translating plate into rotational motion of the shell about the shell axis;

engaging the first engagement portion with the groove on a first side of the drum axis;

rotating the drum assembly about the drum axis to cause the translating member to reciprocatingly translate back and forth in a cycle in which;

the first engagement portion is pulled in a first direction toward an outer edge of the disc, by the rotation of the disc, the pulling of the first engagement portion causing the translating plate to translate generally along a line in the first direction;

the first engagement portion is forced out of the groove at the second end by the tapering of the second end, causing the translating member to pivot so that the second engagement portion simultaneously engages the groove on a second side of the drum axis, the second side being opposite to the first side;

second engagement portion is pulled in a second direction toward an outer edge of the disc, by continued rotation of the disc, the pulling of the second engagement portion causing the translating member to translate generally along a line in the second direction, the second direction being generally opposite to the first direction; and the second engagement portion is forced out of the groove at the second end by the tapered end, causing the translating member to pivot so that the first engagement portion simultaneously engages the groove on the first side of the axis; and spooling linear material through the aperture and onto the drum as the drum assembly rotates;

wherein the linkage converts the reciprocating translation of the translating member into reciprocating rotation of the shell about the shell axis, the aperture translating through an arc in front of the drum so that the linear material is spooled substantially uniformly onto a length of the drum.

* * * * *

UNITED STATES PATENT AND TRADEMARK OFFICE

CERTIFICATE OF CORRECTION

PATENT NO. : 6,279,848 B1 
DATED : August 28, 2001
INVENTOR(S) : Russell C. Mead Jr.

It is certified that error appears in the above-identified patent and that said Letters Patent is hereby corrected as shown below:

Column 15,
Line 35, change "provide" to -- providing --.

Column 16,
Line 45, change "second" to -- the second --.

Signed and Sealed this

Eighteenth Day of June, 2002

*Attest:*

*Attesting Officer*

JAMES E. ROGAN
*Director of the United States Patent and Trademark Office*